US005834063A

United States Patent [19]

Sato

[11] Patent Number: 5,834,063

[45] Date of Patent: Nov. 10, 1998

[54] RECORDING MEDIUM AND METHOD OF PRODUCING THE SAME

[75] Inventor: Kazuo Sato, Tokyo, Japan

[73] Assignee: Nisshinbo Industries, Inc., Tokyo, Japan

[21] Appl. No.: 810,287

[22] Filed: Mar. 3, 1997

Related U.S. Application Data

[62] Division of Ser. No. 595,960, Feb. 6, 1996, abandoned.

[30] Foreign Application Priority Data

Feb. 7, 1995 [JP] Japan ..... 7-041433

[51] Int. Cl.[6] ..... B05D 3/02; B05D 5/02

[52] U.S. Cl. ..... 427/257; 427/256; 427/258; 427/261; 427/385.5; 427/427; 427/379; 427/387; 427/407.1

[58] Field of Search ..... 427/256, 257, 427/258, 261, 385.5, 387, 407.1, 379, 381, 382

[56] References Cited

U.S. PATENT DOCUMENTS

| | | | |
|---|---|---|---|
| 3,769,063 | 10/1973 | Kizawa | 117/41 |
| 4,075,050 | 2/1978 | Takashi et al. | 156/229 |
| 4,481,244 | 11/1984 | Haruta et al. | 428/155 |
| 4,496,629 | 1/1985 | Haruta et al. | 428/341 |
| 4,544,580 | 10/1985 | Haruta et al. | 427/261 |
| 4,572,847 | 2/1986 | Haruta et al. | 427/261 |
| 4,663,216 | 5/1987 | Toyoda et al. | 428/212 |
| 4,705,719 | 11/1987 | Yamanaka et al. | 428/323 |
| 5,085,932 | 2/1992 | Fujita et al. | 428/331 |
| 5,215,812 | 6/1993 | Kano et al. | 428/219 |
| 5,354,601 | 10/1994 | Kamijo et al. | 428/216 |

FOREIGN PATENT DOCUMENTS

| | | |
|---|---|---|
| 0 156 532 | 10/1985 | European Pat. Off. . |
| 0 477 970 | 4/1992 | European Pat. Off. . |
| 0 634 285 | 1/1995 | European Pat. Off. . |

*Primary Examiner*—Shrive Beck
*Assistant Examiner*—Michael Barr
*Attorney, Agent, or Firm*—Wenderoth, Lind & Ponack L.L.P.

[57] ABSTRACT

A recording medium for use in various types of cards required to accept printed and written marks has a writing layer exhibiting excellent ink absorption ability and high surface layer strength. The recording medium comprises a base material provided with a coating whose surface has irregular surface cracks and a center-line mean roughness Ra of 0.5 μm–2.5 μm. The formation of the coating layer includes a drying step conducted in two or more stages using a drying temperature in the second stage that is 10° C.–40° C. lower than that in the first stage.

13 Claims, 2 Drawing Sheets

RECORDING MEDIUM AND METHOD OF PRODUCING THE SAME

This application is a division of now abandoned application Ser. No. 08/595,960, filed Feb. 6, 1996.

BACKGROUND OF THE INVENTION

1. Field of the Invention

This invention relates to a recording medium usable for fabricating identification cards, driver's licenses, commuter's tickets, ATM cards and the like and especially adapted for enabling marks to be recorded on the back surface thereof by imprinting with a water-color ink stamp, writing with a water-color felt pen, water-color ball-point pen, fountain pen, pencil or other such writing instrument, or imprinting with cinnabar seal-ink.

2. Description of the Background Art

The characters, images, etc. printed on the front surface of such a card or the like are produced by a well-known printing methods such as, offset printing, gravure printing or silk screen printing, or by a thermal dye transfer printing method, such as, the process disclosed in Japanese Utility Model Public Publication Hei 5-31975, a melt-transfer thermal printing method, such as, the process disclosed in Japanese Utility Model Application Hei 5-46191 or other similar means. For the rear surface of the card, the practice has been to use, for example, high-grade paper, coated paper or other ordinary paper, a plastic film of polypropylene, polyethylene terephthalate, polyvinyl chloride, polystyrene, a foamed film of one of these or a film of one of these admixed with an inorganic pigment such as calcium carbonate, or synthetic paper obtained by coating a plastic film with a pigment coating layer.

Among these prior art methods, ordinary paper has the disadvantage of poor water resistance. While plastic films are highly resistant to water, they have almost no ability to absorb water-color or other type inks. Hence, plastic films are difficult to mark with a water-color felt pen, water-color ball-point pen, a fountain pen or the like. On the other hand, cinnabar ink impressed thereon with a seal takes around 48 hours to naturally dry. In the meantime, it usually experiences rubbing, smears, and a soiled surface. In short, none of the prior-art materials has much practical utility.

Although synthetic paper has better writability than the plastic film, owing to the ink absorption ability of the pigment coating layer, a mark made thereon with a water-color ink stamp nevertheless takes 7 to 12 minutes to dry, while a drying time of more than 3 minutes is generally considered to cause problems.

It is not practicable to reduce the drying time to under 3 minutes by including a large amount of pigment in the pigment coating layer. The increased pigment content lowers the strength of the coating layer, thus increasing the risk of the coating falling off when subjected to an impact, such as, by abrasion or by bending.

A seal impression made on the synthetic paper with cinnabar seal-ink also takes more than 3 minutes to dry, generally at least 7 minutes, as in the case of a water-color ink stamp impression.

This invention was accomplished in light of the aforesaid shortcomings of the prior art and has as one object to provide a mark-accepting material usable for identification cards, driver's licenses, commuter's tickets, ATM cards and the like. The invention is especially adapted for accepting marks on the back surface thereof by imprinting with a water-color ink stamp, writing with a water-color felt pen, water-color ball-point pen, fountain pen, pencil or other such writing instrument, or imprinting with cinnabar seal-ink, which mark-accepting material is not susceptible to soiling of its surface by smearing when rubbed. Further, the invention has an excellent water resistance, dries within 3 minutes of being marked by writing or stamping with a water-color ink stamp, fountain pen, water-color felt pen, a seal using cinnabar seal-ink or the like, and a coating strength which is strong enough to prevent the coating from coming off even when subjected to an abrasion or an impact such as by bending. Another object of the invention is to provide a mark-accepting material which when used for a card or the like provides a coating surface with good sliding property.

SUMMARY OF THE INVENTION

For achieving these objects, the present invention provides a recording medium comprising a sheet having a writing layer on at least one side of a base material, the writing layer surface having irregular surface cracks and a center-line mean roughness (Ra) of 0.5 $\mu$m–2.5 $\mu$m.

Through studies conducted for overcoming the aforesaid problems, the inventor discovered that when a large number of cracks are produced in a pigment coating layer, serving as a writing layer, ink applied to the writing layer is absorbed through the cracks. Since a short drying time can therefore be achieved with a coating layer containing only a small amount of pigment, it is also possible to obtain a coating of adequately high strength.

The inventor further discovered that the abrasion resistance of the coating layer surface can be increased by ensuring that the center-line mean roughness of the coating layer surface falls within the prescribed value range stated above.

This invention was achieved on the basis of these discoveries.

The above and other features of the invention will become apparent from the following description made with reference to the drawings.

DESCRIPTION OF THE PREFERRED EMBODIMENTS

The invention will now be explained in detail.

The recording medium according to this invention is produced as follows.

Figure 1:
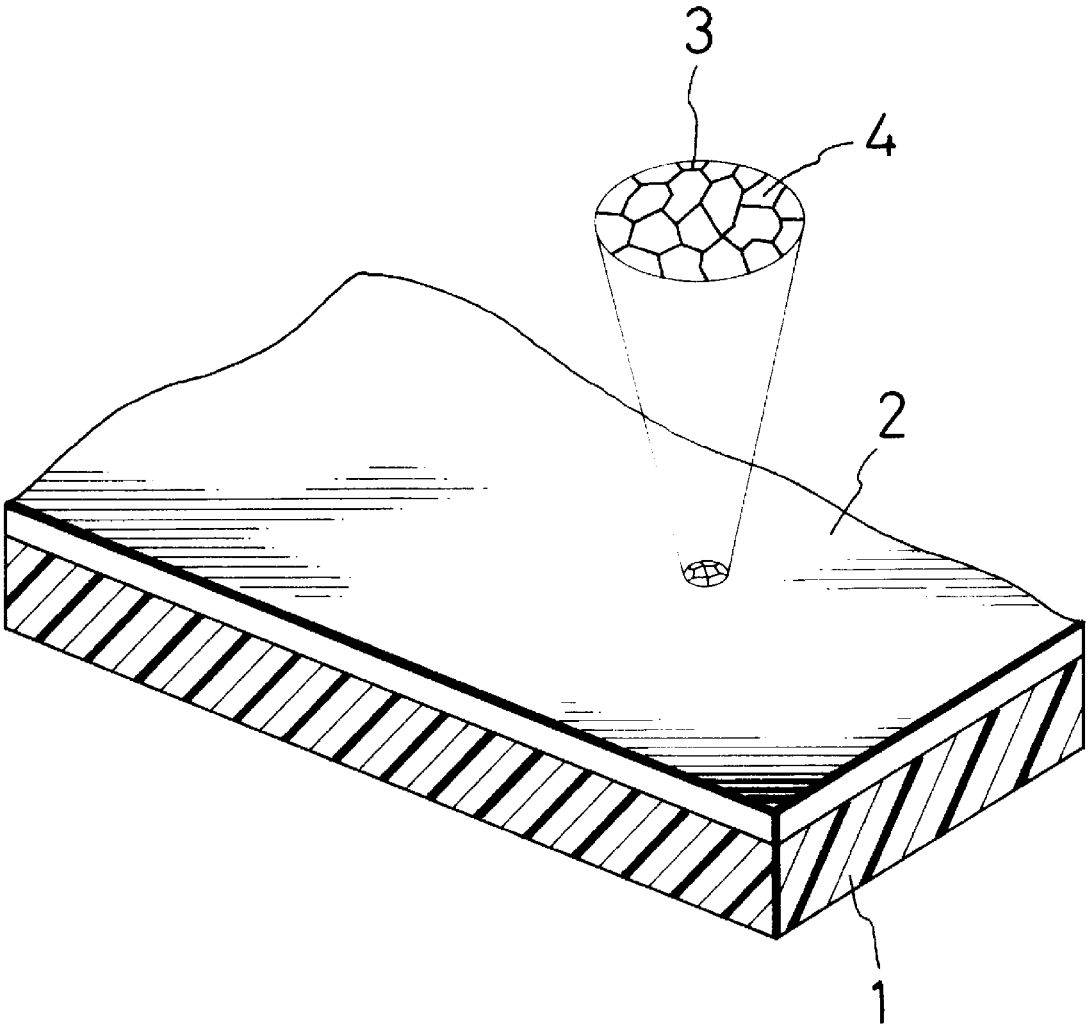
FIG. 1 is a schematic view of the structure of a recording medium according to the invention.

The structure of the recording medium is shown in FIG. 1, in which reference numeral 1 designates a base material made of plastic film. While the type of plastic is not particularly specified, preferable examples include polyethylene terephthalate, polypropylene, polyvinyl chloride, polystyrene, a foamed film of one of these or a film of one of these admixed with an inorganic pigment such as calcium carbonate.

It is also possible to use a laminated paper obtained by laminating a film of one of the foregoing plastics on one or both sides of ordinary paper.

A pigment coating layer 2 is formed on the base material 1 as a writing layer. The pigment coating layer 2 consists basically of a binder and an inorganic or organic pigment.

The binder used is a polymer exhibiting film forming property. For obtaining optimum water resistance, the binder composition (in terms of solid component) preferably consists mainly of a hydrophobic binder. Since a hydrophilic binder having a hydroxyl group, carboxyl group or the like lowers the water resistance of the coating, it should, if used at all, preferably be limited to less than 20 wt % of the total binder composition.

Usable polyvinyl binders include, for example, polystyrene, polyvinyl chloride, polyvinylidene chloride, polyacrylonitrile, saturated copolymerized polyester, polyvinyl chloride-polyvinyl acetate copolymer, alkyd resin, SBR (styrene-butadiene rubber), ABS (acrylonitrilebutadiene-styrene copolymer) and the like.

Use of a hydrophilic binder is effective for improving printability and adhesion with water-color inks and the like. Preferable hydrophilic binders include, for example, polyvinyl alcohol, polyvinyl pyrrolidone, polyvinyl acetal, polyethylene glycol, polyethyleneimine, carboxymethyl cellulose, starch, casein and the like.

Preferable inorganic pigments include, for example, synthetic silica, clay, talc, diatomaceous earth, calcium carbonate, calcined kaolin, titanium oxide, zinc oxide, satin white and the like. Preferable organic pigments include, for example, polystyrene, poly(methyl methacrylate), styrene-acryl copolymer and the like.

The grain diameter of the pigment is preferably 0.1 μm–30 μm, more preferably 1 μm–20 μm.

The pigment coating layer 2 is formed by coating the base material 1 with a pigment coat-forming liquid in an amount to obtain a dried coating thickness generally of 5 μm–50 μm and preferably of 10 μm–40 μm, and drying the applied coating. The coating is applied using a conventional method such as roll coating, wire-bar coating, gravure coating or air knife coating.

The reason for limiting the thickness of the pigment coating layer to within the aforesaid range is that when it is thinner than 5 μm, its ink absorption ability is extremely poor and the time required for ink drying exceeds 3 minutes, and when it is thicker than 50 μm, its strength becomes unacceptably low.

The solid content weight (R) and the pigment solid content weight (F) of the coat-forming liquid are adjusted to a ratio F/R of 0.3–2.0. Although a higher pigment content improves the ink liquid absorption ability, drying property and smear resistance of the pigment coating layer, it reduces the strength of the coating. In this invention, therefore, high coating strength is achieved by limiting the pigment content to within the foregoing range and the absorption ability is increased by producing fine cracks, as will be explained below.

Figure 2:
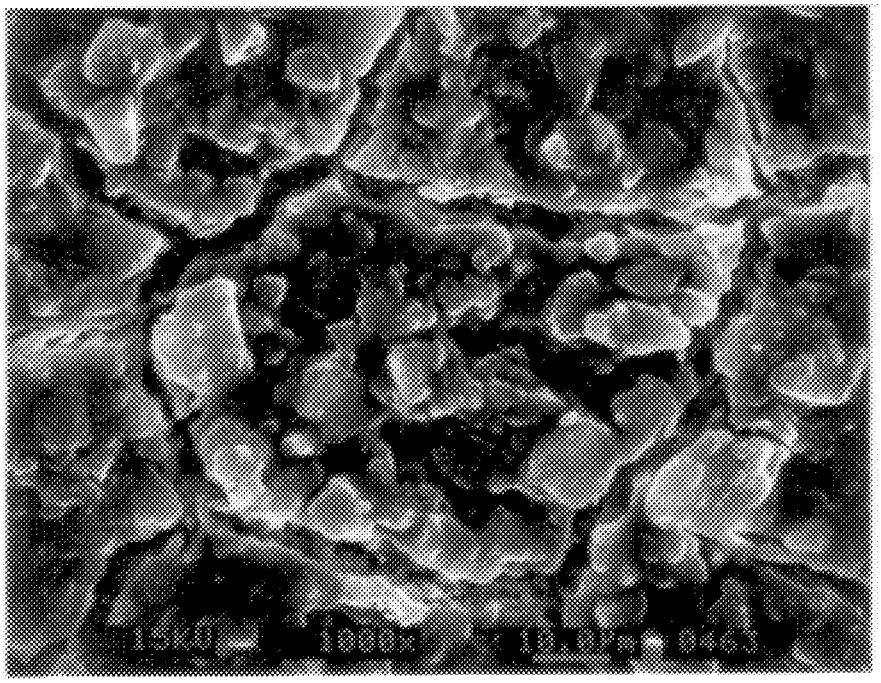
FIG. 2 is a scanning electron micrograph showing cracks in the surface of a recording medium according to the invention.

As shown in FIG. 1 and the electron micrograph (×1000) of FIG. 2, the surface of the pigment coating layer 2 formed in the aforesaid manner has irregular line-like cracks 3 too small to observe with the naked eye. Most of the cracks 3 extend as far as the surface of the base material 1. In other words, the pigment coating layer 2 is a film having scales 4.

The subdivisions defined by the fine, two-dimensional network of irregular cracks have areas (converted to the areas of equivalent squares) which generally fall in the range of 10 μm×30 μm–100 μm×300 μm. The areas of the subdivisions can be varied substantially as desired within this range by appropriate adjustment of the coat-forming liquid, film formation conditions, and/or the drying conditions after coating. It is therefore possible to optimize the pigment coating layer 2 for its purpose of use. The crack width is in the approximate range of 1 μm–10 μm.

As will be better understood from Example 1 set forth below, the formation of cracks can be promoted by conducting the drying in two or more stages and setting the drying temperature in the second stage 10° C.–40° C. lower than in the first stage.

When cracks are formed in the surface of the pigment coating layer in the foregoing manner and a pigment coating layer containing only a small amount of pigment (having an F/R ratio of not more than 2.0) is used, the gaps formed by the cracks make a large contribution to ink absorption. As a result, it is possible to realize an ink absorption ability sufficient for achieving the purpose of the invention, while, at the same time, realizing a high coating strength.

Another feature of the invention is that the value of the center-line mean roughness Ra of the coating surface is controlled to 0.5 μm–2.5 μm. Ra is defined as follows.

The center-line mean roughness Ra, when the roughness curve has been expressed by y=f (x), shall be a value, being expressed in micrometer (μm), that is obtained from the following formula, extracting a part of measuring length l in the direction of its center-line from the roughness curve, and taking the center-line of this extracted part as X-axis and the direction of vertical magnification as Y-axis (JIS B0601-1982 Definitions and Designation of Surface Roughness).

$$Ra = \frac{1}{l}\int_0^l |f(x)|\,dx$$

Since the surface projections are very easily removed by frictional impact when the value of Ra exceeds 2.5 μm, it is necessary for the value of Ra to be not more than 2.5 μm, preferably not more than 2.0 μm.

Although a value of Ra smaller than 0.5 μm provides high resistance to frictional impact, the surface of the resulting cards or the like cannot easily be printed with a printer, etc., because the surface's excessive smoothness makes it difficult to feed to the printer and may cause two or more cards to be fed simultaneously.

The value of Ra is therefore defined as not less than 0.5 μm, preferably not less than 1.0 μm.

A value of Ra in the range of 0.5 μm–2.5 μm can be achieved by reducing the pigment content so that the F/R ratio falls in the range of 0.3–2.0.

The adhesion between the base material 1 and the pigment coating layer 2 can be effectively strengthened by providing the surface of the base material 1 with an undercoating or subjecting it to corona discharge treatment. To prevent generation of static electricity, the surface and/or interior of the pigment coating layer 2 can be subjected to antistatic treatment.

The invention will now be explained with reference to examples. The parts or percentages mentioned in the examples and comparative examples are parts or percentages by weight, respectively.

EXAMPLE 1

The base material used is a polypropylene film including calcium carbonate (Yupo DFG-65, product of Ohji-Yuka Synthetic Paper Co., Ltd.). One surface of the base material was provided with an undercoating of acrylic binder (Movinyl 8020, product of Hoechst AG) having a dry film thickness of 1 μm.

Next, a coat-forming liquid prepared by thoroughly mixing and dispersing 25 parts silica (Mizukasorb C-1, product of Mizusawa Industrial Chemicals, Ltd.) and 70 parts water in 100 parts of a saturated copolymerized polyester binder (solid content concentration of 30%; Vyronal MD-1200, product of Toyobo Co., Ltd.) was coated on the undercoating of the base material using a reverse roll coater. The result was dried by passage through a three-chamber drier (Temp. 1st chamber: 110° C., 2nd chamber: 80° C., 3rd chamber: 100° C.). As a result there was obtained a recording medium according to the invention having many surface cracks defining a large number of subdivisions measuring about 70 μm×100 μm.

It is preferable to establish a temperature gradient in the drier, with the temperature of the 1st chamber being 80° C.–120° C. and the temperature of the 2nd chamber being 10° C.–40° C. lower than that of the 1st chamber, and to drive out the residual solvent in the 3rd chamber.

The pigment coating layer of the so-produced recording medium had a thickness of 20 μm and a center-line mean roughness of 1.6 μm.

Characters stamped on the recording medium using a commercially available water-color ink stamp manufactured by Shachihata Co., Ltd. dried completely in 26 seconds.

The pigment coating layer surface did not incur any surface layer removal in an abrasion test involving 1,000 reciprocations under a load of 1 kg, nor did bending cause any removal of the surface layer.

EXAMPLE 2

A foamed polyethylene terephthalate film (Crysper-100, product of Toyobo Co., Ltd.) is used as the base material and was coated on one side with an undercoating similar to that of Example 1.

Next, a coat-forming liquid prepared by thoroughly mixing and dispersing 45 parts diatomaceous earth (Radiolight F, product of Showa Chemical Co., Ltd.) and 100 parts water in 100 parts of a polyvinyl chloride-polyvinyl acetate copolymer binder (solid content of 33%; Vinybran 240, product of Nisshin Chemical Industry Co., Ltd.) was coated on the undercoating of the base material using a wire-bar coater. The result was dried by passage through a three-chamber drier (Temp. 1st chamber: 120° C., 2nd chamber: 75° C., 3rd chamber: 110° C.). As a result there was obtained a recording medium according to the invention having innumerable surface cracks defining subdivisions measuring about 50 μm×80 μm.

The pigment coating layer of the so-produced recording medium had a thickness of 15 μm and a center-line mean roughness of 1.8 μm.

Characters stamped on the recording medium using the same water-color ink stamp as in Example 1 dried completely in 53 seconds.

The pigment coating layer surface did not incur any surface layer removal in the same surface abrasion test as in Example 1, nor did bending cause any removal of the surface layer.

COMPARATIVE EXAMPLE 1

A recording medium was produced in the same manner as in Example 1 except that the temperatures of the 1st to 3rd chambers of the drier were all set at 70° C. The surface of the recording medium was found to be completely free of cracks.

The pigment coating layer of the so-produced recording medium had a thickness of 20 μm and a center-line mean roughness of 1.2 μm.

Characters stamped on the recording medium using the same water-color ink stamp as in Example 1 took 7 minutes and 45 seconds to dry completely.

COMPARATIVE EXAMPLE 2

A recording medium was produced in the same manner as in Example 1 except that the coat-forming liquid was prepared by adding 90 parts silica and 130 parts water to 100 parts binder. When the coat-forming liquid was applied to the base material and dried in the same manner as in Example 1, there was obtained a recording medium having surface cracks defining areas measuring about 120 μm ×400 μm.

The pigment coating layer of the so-produced recording medium had a thickness of 24 μm and a center-line mean roughness of 3.6 μm.

Characters stamped on the recording medium using the same water-color ink stamp as in Example 1 dried completely in 13 seconds. However, the pigment coating surface incurred surface layer removal in an abrasion test similar to that in Example 1 after only two reciprocations, and also suffered removal of the surface layer when bent.

As is clear from the foregoing description, this invention realizes a recording medium whose pigment coating layer exhibits good ink absorption ability even when formed to have high strength and is also highly resistant to frictional impacts and the like, and is thus able to provide a recording medium with excellent performance as regards both ink absorption ability and strength of its pigment coating layer.

What is claimed is:

1. A method of producing a recording medium comprising a base material and a writing layer, wherein said writing layer comprises a pigment coating layer having a surface with irregular surface cracks and a center-line mean roughness (Ra) of 0.5 μm–2.5 μm and said writing layer is on at least one side of said base material, said method comprising the steps 1) optionally providing an undercoating on said base material;
2) forming a pigment coating layer on the base material or undercoating by applying a composition comprising a copolymerized saturated polyester binder, pigment, and a solvent and/or a dispersant onto said base material or said undercoating, and
3) drying said pigment coating in two or more stages wherein the drying temperature of the second stage is 10° C.–40° C. lower than the first stage.

2. A method according to claim 1, wherein the pigment coating layer contains a pigment having a solid content weight of F and a total weight content of R, the ratio of F/R being in the range of 0.3–2.0.

3. A method according to claim 1, wherein the pigment is organic.

4. A method according to claim 3, wherein the organic pigment is selected from the group consisting of polystyrene, poly(methyl methacrylate) and styrene-acryl copolymer.

5. A method according to claim 1, wherein the pigment is inorganic.

6. A method according to claim 5, wherein the inorganic pigment is selected from the group consisting of silica, clay, talc, diatomaceous earth, calcium carbonate, calcined kaolin, titanium dioxide, zinc oxide and satin white.

7. A method according to claim 1, wherein the pigment has a grain diameter in the range of 0.1 $\mu$m–30 $\mu$m.

8. A method according to claim 1, wherein the pigment coating layer has a dried coating thickness of 5 $\mu$m–50 $\mu$m.

9. A method according to claim 1, wherein the base material is undercoated prior to the application of the pigment coating layer.

10. A method according to claim 1, wherein the first drying stage is at a temperature of 80° C.–120° C.

11. A method according to claim 1, comprising a third drying stage to drive out the residual solvent.

12. A method according to claim 10, comprising a third drying stage to drive out the residual solvent.

13. A method according to claim 1, wherein the drying step takes place in a chamber drier.

* * * * *